US007950845B1

(12) United States Patent
Syed et al.

(10) Patent No.: US 7,950,845 B1
(45) Date of Patent: May 31, 2011

(54) TIME KEEPING SYSTEM FOR TURN-BASED GAMES

(76) Inventors: Omar Syed, Murphy, TX (US); Aamir Syed, Murphy, TX (US)

( * ) Notice: Subject to any disclaimer, the term of this patent is extended or adjusted under 35 U.S.C. 154(b) by 0 days.

(21) Appl. No.: 12/793,531

(22) Filed: Jun. 3, 2010

(51) Int. Cl.
*G04F 3/00* (2006.01)

(52) U.S. Cl. ..... 368/96; 463/14

(58) Field of Classification Search ..... 368/96, 368/89; 463/14
See application file for complete search history.

(56) References Cited

U.S. PATENT DOCUMENTS 5,796,680 A * 8/1998 Franklin ..... 368/96
5,957,455 A * 9/1999 Aldridge ..... 273/260
6,904,001 B1 * 6/2005 Rast ..... 368/71
7,004,469 B2 * 2/2006 von Goeben ..... 273/348
7,410,418 B2 * 8/2008 Potter ..... 463/14
7,507,157 B2 * 3/2009 Vale et al. ..... 463/30
7,749,058 B2 * 7/2010 Kershaw ..... 463/14
7,846,016 B2 * 12/2010 Bozeman ..... 463/17
7,887,232 B1 * 2/2011 Jones, Jr. ..... 368/96
2001/0034256 A1 * 10/2001 Green ..... 463/1
2003/0176221 A1 * 9/2003 Chung ..... 463/42
2003/0228896 A1 * 12/2003 Iida et al. ..... 463/14
2004/0065999 A1 * 4/2004 Syed et al. ..... 273/260
2005/0243655 A1 * 11/2005 McCutcheon et al. ..... 368/107
2006/0148571 A1 * 7/2006 Hossack et al. ..... 463/43
2007/0037622 A1 * 2/2007 Chan ..... 463/14
2007/0060226 A1 * 3/2007 Sakaguchi et al. ..... 463/1
2008/0182675 A1 * 7/2008 Flores ..... 473/27
2009/0217328 A1 * 8/2009 Colmagro et al. ..... 725/91

* cited by examiner

*Primary Examiner* — Sean Kayes

(57) ABSTRACT

We present a time keeping system for turn-based games which accepts time controls used in fast games but allows the game to be played in a correspondence manner similar to slow games. This gives players the enjoyment of playing fast games with time pressure but at a pace that is convenient for their busy schedule.

2 Claims, 2 Drawing Sheets

TIME KEEPING SYSTEM FOR TURN-BASED GAMES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

A turn-based game is one in which two or more players alternate being the active player to change the state of the shared game. The active player has the right to make changes to the current state of the game based on the predetermined rules of the game while the one or more non-active players must remain passive until the active player has finished. The players take turn being the active player. For the purpose of this invention the method of selecting the active player on any given turn does not matter, but is predetermined before the start of the game. This patent does not cover real-time games in which two or more players are simultaneously active and may concurrently manipulate the state of the shared game.

In order to keep a turn-based game progressing forward in a manner that is fair to all the players, a time keeping system is used to make sure that the active player uses only a predetermined amount of time to change the current state of the game. For example in the game of Chess a pair of clocks is used to keep the amount of time that each player has used. If a player uses more than the allotted time the predetermine rules decide the consequence for the active player. For example in Chess it is common for the active player to lose the game if the active player uses more than the allotted time. In other games the player may lose only the turn and not the game.

Before the game begins the time keeping system is configured with the amount of time allotted for the players. The specification of the allotted time is refereed to as a time control. Time controls are typically specified in terms of how much time the player may use per turn or how much total time the player may use for all turns of the game. For the purpose of this invention the details of the time control specification is not relevant. A fast game is one where the time control is fast enough to allow the game to be finished in a few hours. An example of a fast game is when the players must make each move within one minute or make all moves within two hours. A slow game is one where the time control is slow enough that the game will take days, months or even years to finish. An example of a slow game is when the players must make each move within two days or make all moves within one year.

Current time keeping systems for turn-based games do not allow the ability for players to engage in a fast time control game over an extended period of time. For example two Chess players may want to play with a time control of one minute per move, but may not have the time to complete the game in one sitting and would prefer to play the game over a period of many days or months. Current time keeping systems do not allow this since the time must always be deducted from the game clock of one player or the other.

The obvious solution of pausing the game by stopping the game clock of the active player so that time is not deducted from it does not work because it allows the active player to continue thinking about the current game state without losing any time. This would be unfair to the other players.

The following documents relating to this invention were considered:

Time keeping systems in games
http://en.wikipedia.org/wiki/Time-keeping_systems_in_games
Time control
http://en.wikipedia.org/wikaime_control
Correspondence chess
http://en.wikipedia.org/wiki/Correspondence chess
Digital Chess Clock
U.S. Pat. No. 4,884,255; Nov. 28, 1989; Robert J. Fischer
Chess Clock U.S. Pat. No. 4,472,067; Sep. 18, 1984; Donald M. Richardson

BRIEF SUMMARY OF THE INVENTION

The present invention describes a system which allows players to engage in games with fast time controls while not requiring them to be continuously present and finish the game in one sitting. The invention describes a system and method which accepts two time controls and provides the ability to conceal the current state of the game from the players until the active player accepts to view the current state of the game.

Before the start of a game the system is configured with two time controls. The first is referred to as the game time control and the second is referred to as the acceptance time control. The system maintains two clocks for each player in the game. The first is referred to as the game clock and the second is referred to as the acceptance clock.

At the start of the active player's turn the allotted time on the game clock is set based on the game time control and the current state of the game clock. At the start of the active player's turn the allotted time on the acceptance clock is set based on the acceptance time control and the current state of the acceptance clock. During the game when a player becomes the active player the current state of the game is not shown to the active player until the active player accepts to view it. When the active player has not yet accepted to view the current state of the game the system deducts time from the player's acceptance clock. After the active player has accepted to view the game and the current state of the game has been shown to the active player the system stops deducting time from the player's acceptance clock and begins deducting time from the player's game clock.

While the active player manipulates the current state of the game the system does not allow the state of the game to be viewed by the other players. Once the active player finishes changing the state of the game and ends the turn the current state of the game is visible only to the active player and the changes are not yet visible to the other players. When the next active player has accepted to view the current state of the game it becomes viewable by all the players. The mechanism for concealing the current state of the game is provided by the game system and is only controlled by the time keeping system.

If the acceptance time control is not specified then the system does not deduct time from the acceptance clock and the active player does not have any time limit in which to accept viewing the current state of the game. However, when the active player has accepted to view the game and the current state of the game has been shown to the active player the system begins deducting time from the active player's game clock.

A key feature of the present invention is that it maintains fairness in the amount of time each player has to think about and change the state of the game while allowing fast time control games to be played over long periods of time.

In a preferred embodiment the time keeping system would be implemented in software to run on a PC, mobile device or web browser.

DETAILED DESCRIPTION OF THE INVENTION

Although the present invention will be illustrated using two players, it is applicable to turn-based games with more than two players. Although the present invention will be illustrated using a time control with a fixed amount of time to make all the moves of the game, it is applicable to other time control formats as well. Although the present invention will be illustrated using human players, it is applicable even if one or more of the players are machines.

Figure 1:
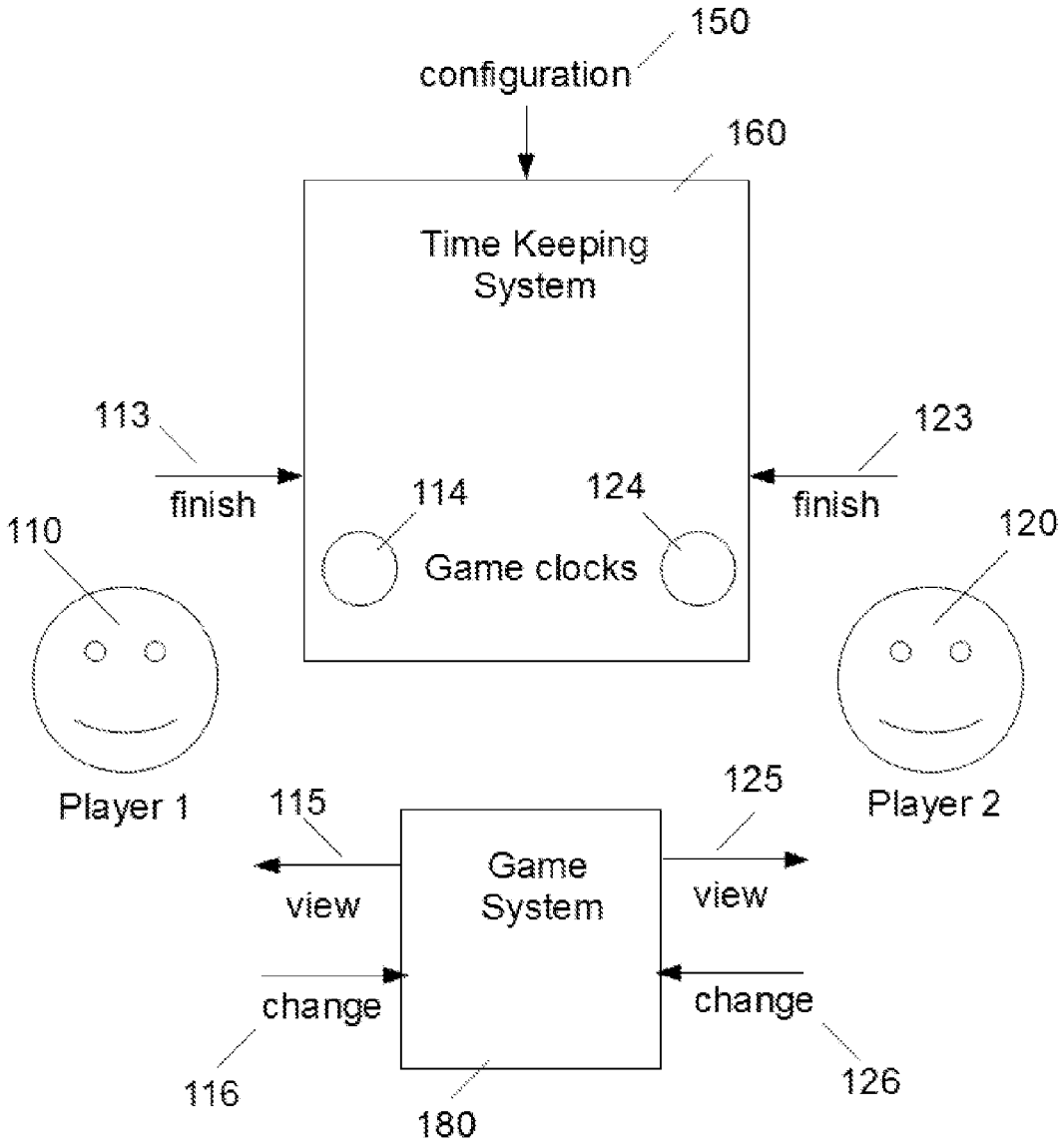
FIG. 1 is a schematic illustration showing the players, the game system and a typical time keeping system.

FIG. 1 is a schematic illustration of the players 110 and 120, the game system 180 and a typical time keeping system 160 for turn-based games which does not provide the benefits of the present invention. Before the game starts the time keeping system 160 is configured through interface 150 based on the time control that was chosen for the game. The remaining time on game clocks 114 and 124 are set using the configuration interface 150. Players are able to view the current state of the game at all times through interface 115 for player 110 and interface 125 for player 120. The active player has the right to change the state of the game through interface 116 for player 110 and interface 126 for player 120. The time keeping system 160 maintains a game clock for each player. Game clock 114 is used for player 110 and game clock 124 is used for player 120. If player 110 is the active player then the time keeping system 160 reduces the time remaining on the game clock 114. When player 110 has finished changing the state of the game player 110 uses interface 113 to notify the time keeping system 160 that player 110 has finished the turn. The time keeping system 160 stops reducing the remaining time on the game clock 114 and begins reducing the remaining time on the game clock 124. Player 120 now becomes the active player and has the right to change the state of the game through interface 126. When player 120 has finished changing the state of the game, player 120 uses interface 123 to notify the time keeping system 160 that player 120 has finished the turn. The time keeping system 160 stops reducing the remaining time on the game clock 124 and begins reducing the remaining time on the game clock 114. Player 110 now becomes the active player. This process of alternating turns between the two players continues until the game has ended.

Figure 2:
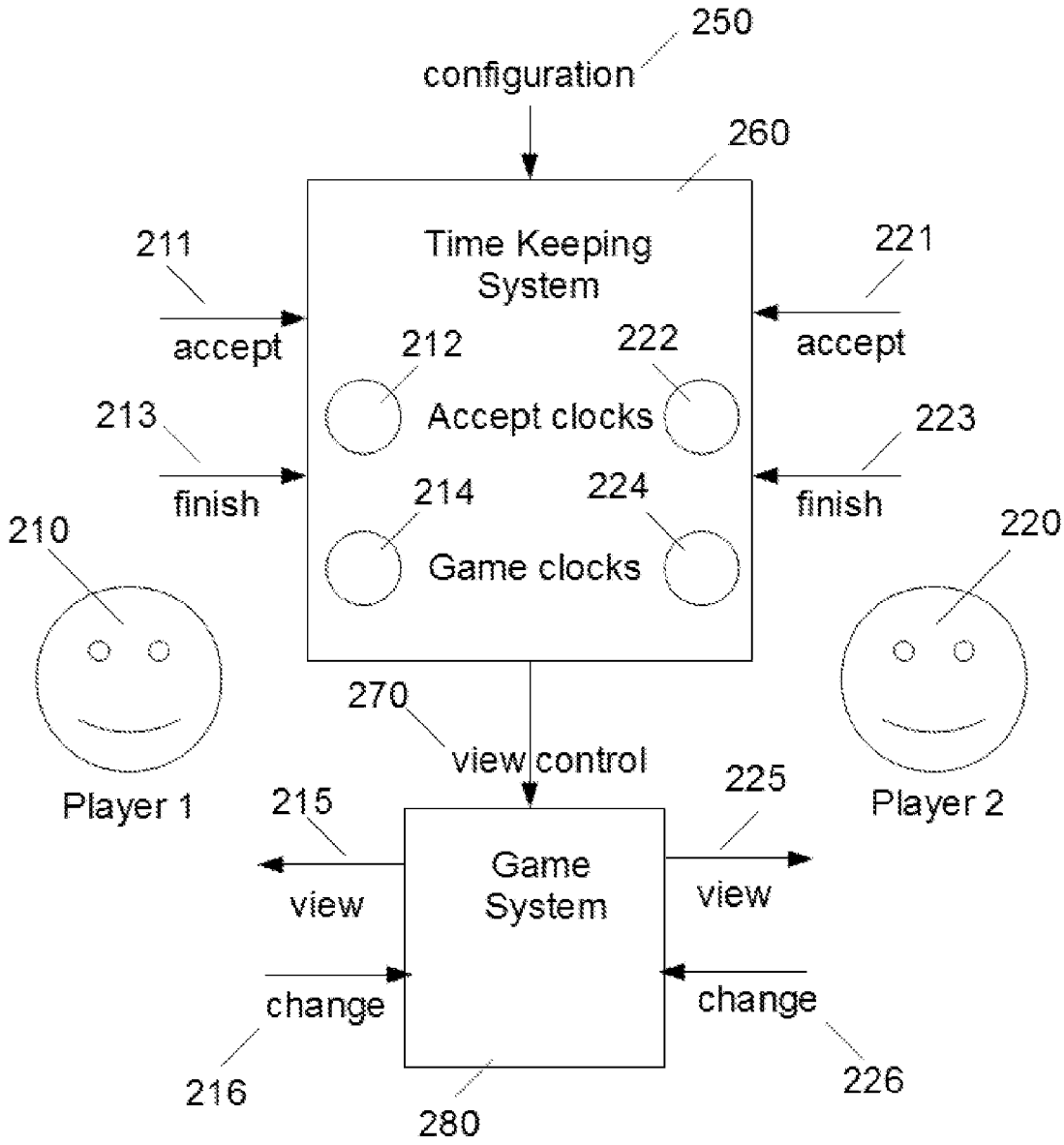
FIG. 2 is a schematic illustration showing the players, the game system and the time keeping system of the present invention.

FIG. 2 is a schematic illustration of the players 210 and 220, the game system 280 and the time keeping system 260 of the present invention. Before the game starts the time keeping system 260 is configured through interface 250 based on the two time controls that were chosen for the game. The remaining time on game clocks 214 and 224 and also the accept clocks 212 and 222 are set using the configuration interface 250.

For the purpose of illustration we assume a scenario where the game starts with player 210 being the active player. When the game starts and player 210 becomes the active player the time keeping system 260 begins reducing the remaining time on accept clock 212. The time keeping system 260 uses interface 270 to notify the game system 280 to not allow the players to view the current state of the game via interfaces 215 and 225. When player 210 uses interface 211 to accept viewing the current state of the game, the time keeping system 260 stops reducing the time on accept clock 212 and begins reducing the time on the game clock 214. The time keeping system 260 uses interface 270 to notify the game system 280 that all players can now view the current state of the game. Player 210 now has the right to change the state of the game using interface 216. The changes being made by player 210 are not viewable to the other players. When player 210 has finished changing the state of the game, player 210 uses interface 213 to notify the time keeping system 260 that player 210 has finished the turn. The time keeping system 260 stops reducing the remaining time on the game clock 214 and begins reducing the remaining time on the accept clock 222. Player 220 now becomes the active player. However, the changes made to the game by player 210 are not yet viewable by player 220. When 220 uses interface 221 to accept viewing the current state of the game, the time keeping system 260 stops reducing the time on accept clock 222 and begins reducing the time on the game clock 224. The time keeping system 260 uses interface 270 to notify the game system 280 that all players can now view the current state of the game. Player 220 now has the right to change the state of the game using interface 226. When player 220 has finished changing the state of the game, player 220 uses interface 223 to notify the time keeping system 260 that player 220 has finished the turn. The time keeping system 260 stops reducing the remaining time on the game clock 224 and begins reducing the remaining time on the accept clock 212. Player 210 now becomes the active player. This process of alternating turns between the two players continues until the game has ended.

The invention claimed is:

1. A time keeping system and method for turn-based games comprising:

a) a configuration interface that allows setting two time controls consisting of:

(1) a first time control that limits a first duration of time an active player may spend on changing a state of the game;

(2) a second time control that limits a second duration of time the active player may spend before receiving a current state of the game;

b) a first clock or timer for each player used to maintain the first duration of time the active player spends on changing the state of the game;

c) a second clock or timer for each player used to maintain the second duration of time the active player spends before receiving the current state of the game;

d) a first interface mechanism which allows the active player to notify the time keeping system that the player accepts to receive the current state of the game;

e) a second interface mechanism which allows the active player to notify the time keeping system that the active player has finished changing the state of the game;

f) a third interface mechanism which allows the time keeping system to notify the game system that all players may view the current state of the game;

wherein the time keeping system is configured to:

g) reduce a first time stored in the active player's second clock or timer when the active player has not notified the time keeping system through the first interface mechanism;

h) reduce a second time stored in the active player's first clock or timer when the active player has notified the time keeping system through the first interface mechanism, but has not notified the said time keeping system through the second interface mechanism;

i) notify the game system that all players may view the current state of the game when the active player has notified the said time keeping system through the first interface mechanism; and j) change the active player responsive to a notification operation through the second interface mechanism.

2. A time keeping system according to claim 1, wherein the first interface mechanism and the second interface mechanism comprise at least one button each.

* * * * *